US006776500B1

(12) United States Patent
Chen

(10) Patent No.: US 6,776,500 B1
(45) Date of Patent: Aug. 17, 2004

(54) LUMINESCENT EXTENSION FOR BOX-ENDED WRENCH

(76) Inventor: Terence Chen, No. 325, Yung Ching Road, Tung Shan Hsiang, Lo Tung Town, Yi Lan Hsien (TW)

( * ) Notice: Subject to any disclaimer, the term of this patent is extended or adjusted under 35 U.S.C. 154(b) by 0 days.

(21) Appl. No.: 10/408,427

(22) Filed: Apr. 7, 2003

(51) Int. Cl.[7] ..... F21V 33/00
(52) U.S. Cl. ..... 362/119; 362/109; 362/120
(58) Field of Search ..... 362/206, 109, 362/119, 120, 253, 208

(56) References Cited

U.S. PATENT DOCUMENTS 2,783,364 A * 2/1957 Wood, Jr. ..... 362/119
2,811,631 A * 10/1957 Wood, Jr. ..... 362/119
5,477,434 A * 12/1995 Reed ..... 362/119
5,848,832 A * 12/1998 Hsieh ..... 362/119
5,897,198 A * 4/1999 Hsieh ..... 362/119
6,079,846 A * 6/2000 Huang ..... 362/119
6,183,103 B1 * 2/2001 Hillinger ..... 362/119
6,508,565 B2 * 1/2003 Wang ..... 362/119

* cited by examiner

*Primary Examiner*—John Anthony Ward
(74) *Attorney, Agent, or Firm*—Alan D. Kamrath; Nikolai & Mersereau, P.A.

(57) ABSTRACT

A luminescent extension is provided for connecting a box-ended wrench with a socket. The luminescent extension includes a cylinder, an upper tubular insert, a light assembly, a cover and a lower tubular insert. The upper tubular insert 11 extends from an upper end of the cylinder for releasable connection with the box-ended wrench. The light assembly is installed in the cylinder. The cover is rotationally mounted on the upper end of the cylinder between an OFF position for turning off the light assembly and an ON position for turning on the light assembly. The lower tubular insert extends from a lower end of the cylinder for releasable connection with the socket. Light can emit from the light assembly through the lower tubular insert.

18 Claims, 5 Drawing Sheets

LUMINESCENT EXTENSION FOR BOX-ENDED WRENCH

BACKGROUND OF INVENTION

1. Field of Invention

The present invention relates to a luminescent extension for a box-ended wrench.

2. Related Prior Art

U.S. Pat. No. 5,826,968 discloses a socket wrench with illumination. This socket wrench 10 includes a handle 20, a ratchet mechanism 22 installed at the handle 20, a lug 24 extending from the ratchet mechanism 22, a socket extension 40 for engagement with the lug 24 and a socket 30 for engagement with the socket extension 40. The socket extension 40 includes a body 42, a battery 46 put in the body 42, a light assembly 50 put in the body 42 and electrically connected with the battery 46 and a socket tool mounting element 60 inserted in the body 42 in a releasable manner. The socket extension 40 is however not suitable for use with a box-ended wrench, nor with an open-ended wrench. Furthermore, the socket extension 40 does not provide light unless it is engaged with the lug 24.

The present invention is therefore intended to obviate or at least alleviate the problems encountered in the prior art.

SUMMARY OF INVENTION

It is an object of the present invention to provide a luminescent extension for connecting a box-ended wrench with a socket.

It is another object of the present invention to provide a luminescent extension that can be switched between an OFF position and an ON position when it is used alone.

According to the present invention, a luminescent extension includes a cylinder, an upper tubular insert, a light assembly, a cover and a lower tubular insert. The upper tubular insert extends from an upper end of the cylinder for releasable connection with a box-ended wrench. The light assembly is installed in the cylinder. The cover is rotationally mounted on the upper end of the cylinder between an OFF position for turning off the light assembly and an ON position for turning on the light assembly. The lower tubular insert extends from a lower end of the cylinder for releasable connection with a socket. Light can emit from the light assembly through the lower tubular insert.

Other objectives, advantages, and novel features of the invention will become more apparent from the following detailed description when taken in conjunction with the attached drawings.

BRIEF DESCRIPTION OF DRAWINGS

The present invention will be described through detailed illustration of the preferred embodiment referring to the attached drawings.

DETAILED DESCRIPTION OF PREFERRED EMBODIMENT

Figure 1:
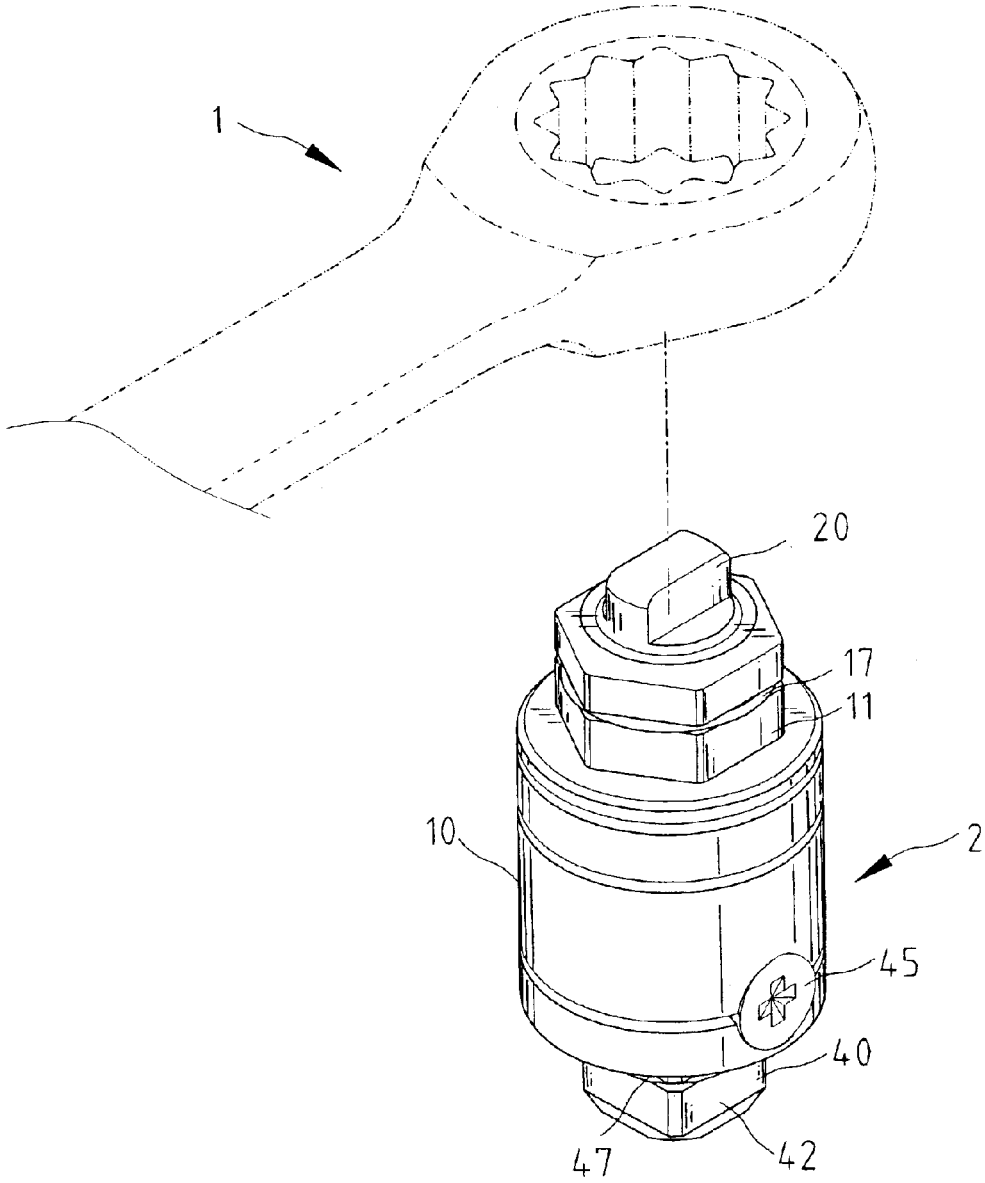
FIG. 1 is a perspective view of a luminescent extension for a box-ended wrench according to the preferred embodiment of the present invention.

Referring to FIG. 1, a box-ended wrench 1 is used with a luminescent extension 2 according to the preferred embodiment of the present invention. The luminescent extension 2 is for releasable connection with the box-ended wrench 1 at an end and for releasable connection with a socket (not shown) at an opposite end.

Figure 2:
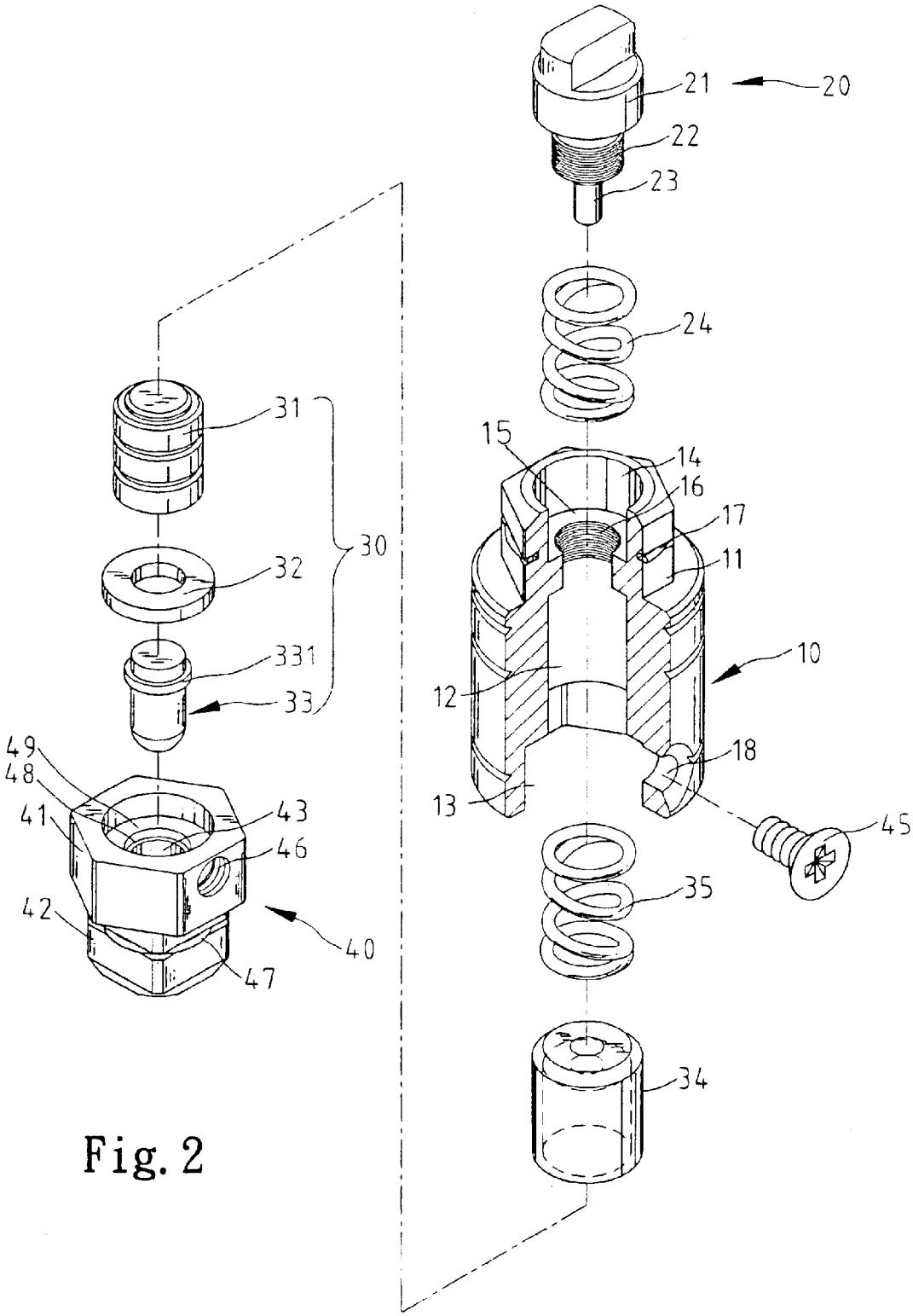
FIG. 2 is an exploded view of the luminescent extension shown in FIG. 1.

Referring to FIG. 2, the luminescent extension 2 includes a cylinder 10, an upper insert 11 connected with an upper end of the cylinder 10, a cover 20 for closing the upper end of the cylinder 10, a light assembly 30 installed in the cylinder 10 and a lower insert 40 connected with a lower end of the cylinder 10.

The cylinder 10 defines a space 12 receiving the light assembly 30, a non-circular recess 13 in the lower end, a transverse hole 18 communicated with the non-circular recess 13, and a circular recess 14 in the upper end. An annular flange 15 extends on an internal face of the cylinder 10 near the upper end. A thread 16 extends on an internal face of the annular flange 15. An elastic frictional ring 17 is put in an annular groove (not numbered) defined in the upper insert 11.

The upper insert 20 includes a thread 22 extending on a lower portion, a rod 23 extending from the lower portion and a knob 21 formed on an upper portion. A spring 24 is put in the circular recess 14. The thread 22 is driven into engagement with the thread 16 via rotating the knob 21.

The light assembly 30 includes a spring 35, a socket 34, several batteries 31, an annular isolator 32 and a light bulb 33. The rod 23 extends into the socket 34. The annular isolator 32 is for keeping the batteries 31 in the socket 34. The light bulb 33 is formed with an annular rib 331.

The lower insert 40 includes an upper portion 41 and a lower portion 42 formed together with the upper portion 41. The upper portion 41 of the lower insert 40 includes a non-circular profile compliant to the non-circular recess. The upper portion 41 of the second insert 40 defines a transverse hole 46. A thread (not numbered) extends on the wall of the transverse hole 46. An elastic frictional ring 47 is put in an annular groove defined in the lower portion 42 of the lower insert. The lower insert 40 defines a space 43 including a lower portion, a middle portion greater than the lower portion and an upper portion greater than the middle portion. An annular shoulder 48 is formed between the lower and middle portions of the space 43, and an annular shoulder 49 between the middle and upper portions of the space 43.

The upper portion 41 of the lower insert 40 is put in the non-circular recess 13 so that the light bulb 33 is put in the lower portion of the space 43 and that the annular rib 331 is put in the middle portion of the space 43. The annular rib 331 rests on the annular shoulder 48. The annular isolator 32 is put in the upper portion of the space 43. The annular isolator 32 rests on the annular shoulder 49.

A bolt 45 is inserted through the transverse hole 18 into the transverse hole 46. A thread (not shown) formed on the bolt 45 is engaged with the thread formed on the wall of the transverse hole 46. Thus, the upper portion 41 of the lower insert 40 is retained in the non-circular recess 13.

Figure 3:
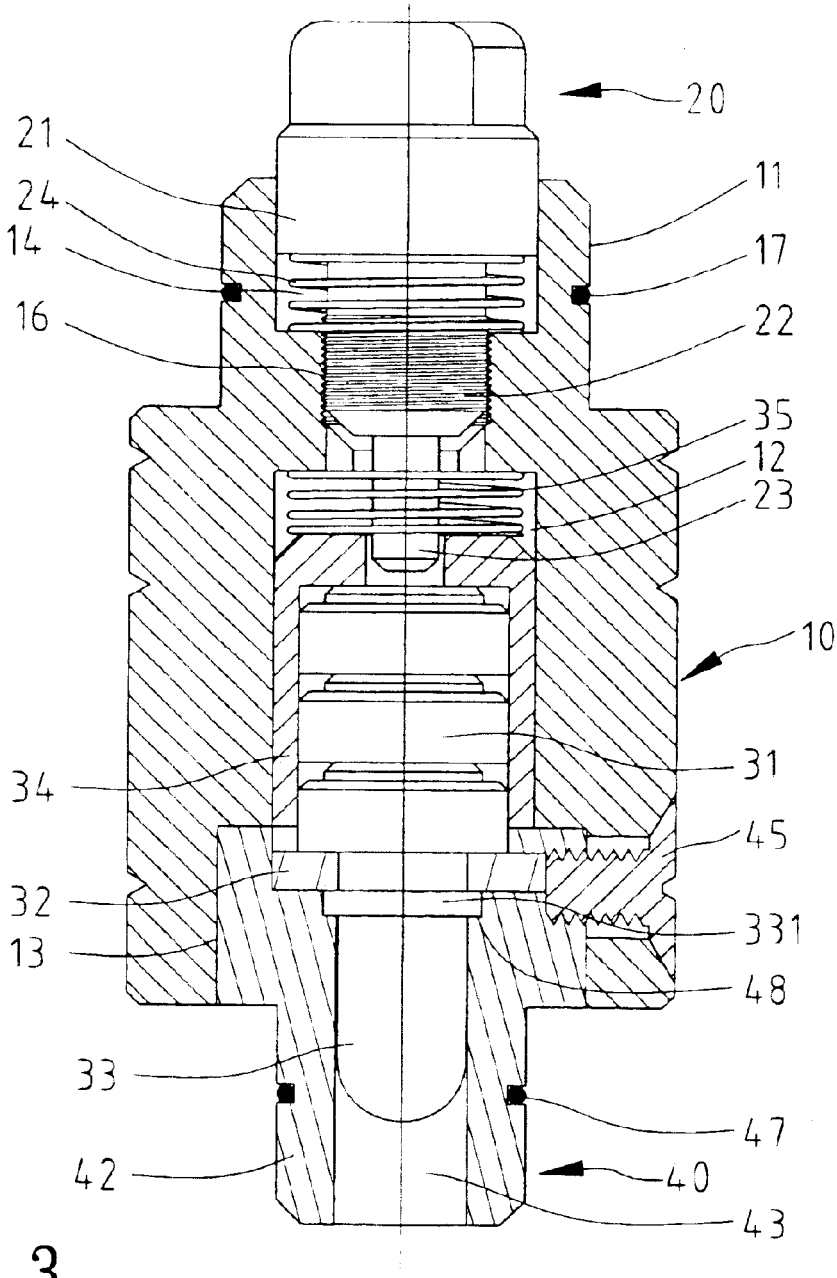
FIGS. 3 and 4 are cross-sectional views of the luminescent extension shown in FIG. 1 in different positions.

Referring to FIG. 3, the rod 23 is not in contact with the batteries 31. Thus, the light bulb 33 is not electrically connected with the batteries 31. In this position, the light bulb 33 does not emit light.

Figure 4:
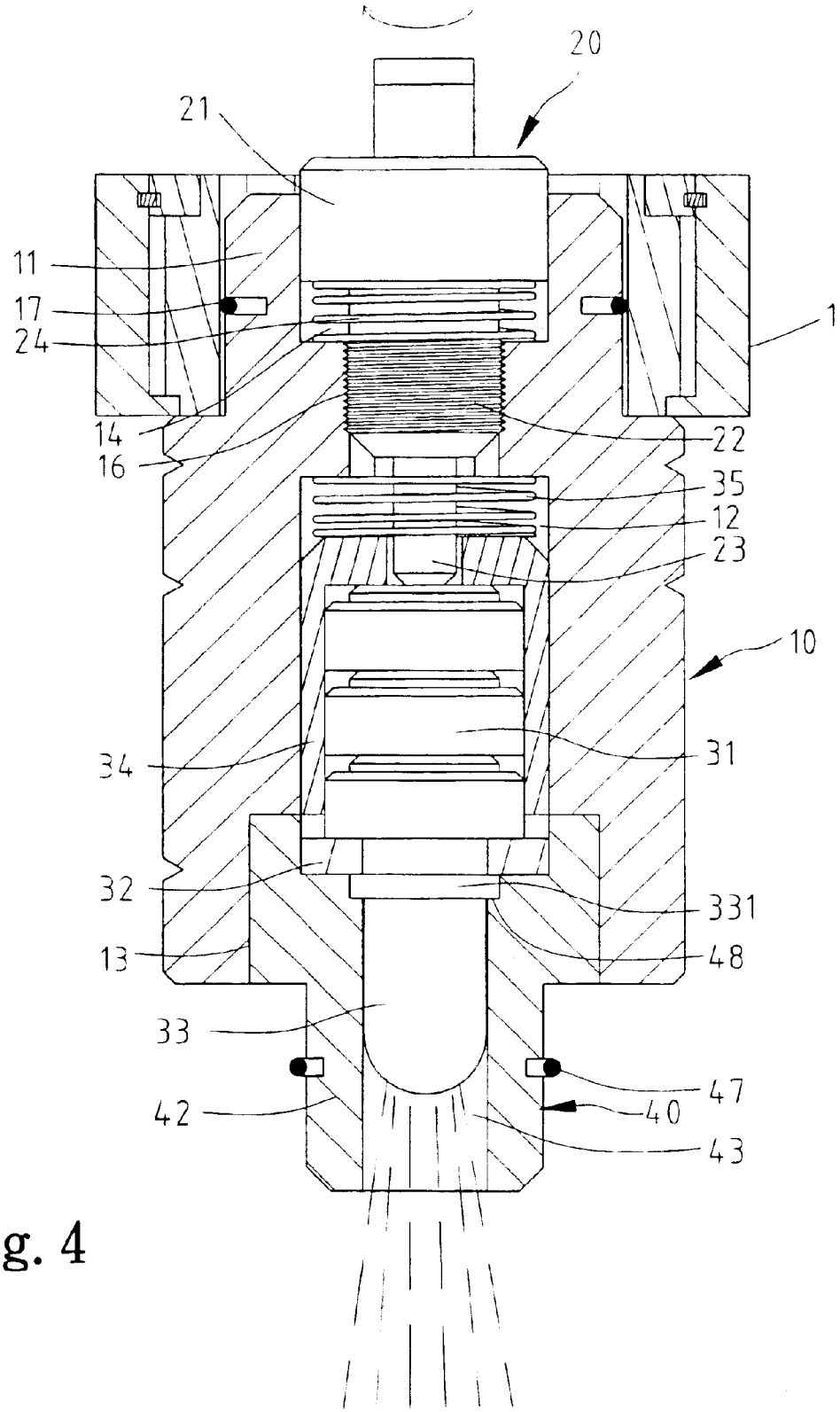

Referring to FIG. 4, the rod 23 is in contact with the batteries 31. Thus, the light bulb 33 is electrically connected with the batteries 31. Therefore, the light bulb 33 emits light.

Figure 5:
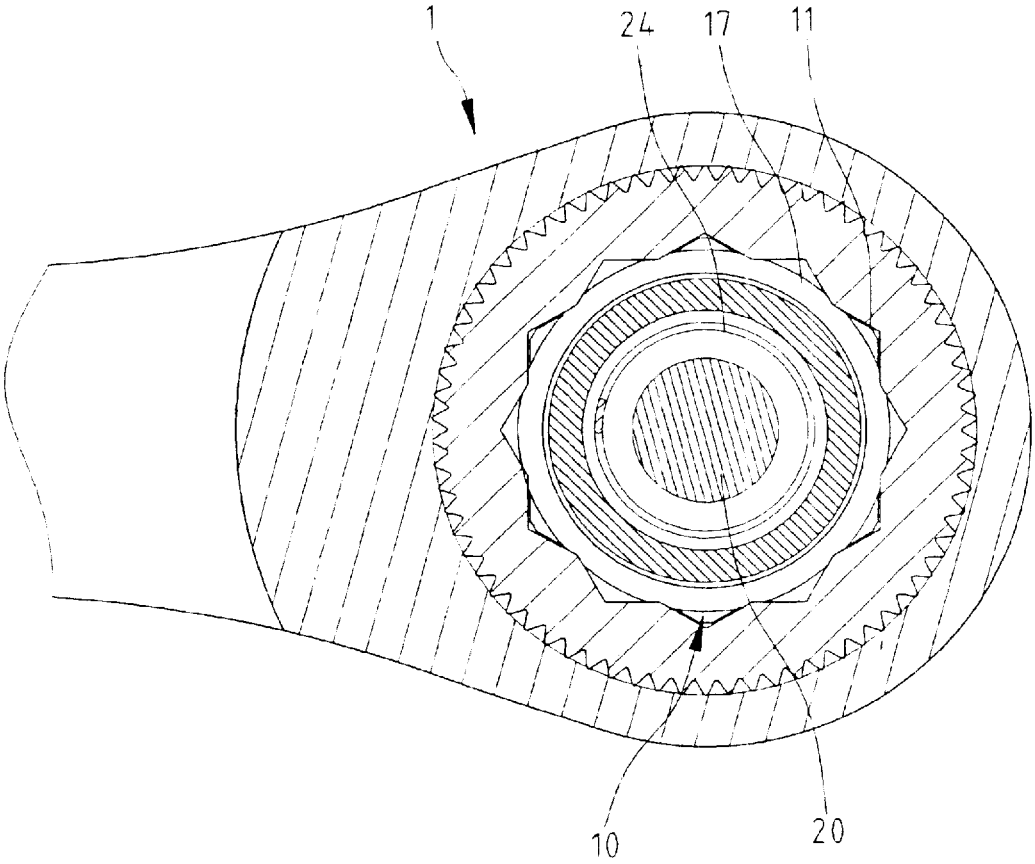
FIG. 5 is a cross-sectional view of the luminescent extension shown in FIG. 1.

Referring to FIG. 5, the elastic frictional ring 17 renders possible firm connection of the upper insert 11 with the box-ended wrench 1. Similarly, the elastic frictional ring 47 renders possible firm connection of the lower insert 40 with a socket.

The present invention has been described through detailed illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A luminescent extension for connecting a box-ended wrench with a socket, the luminescent extension including:

a cylinder with an upper end and a lower end;

an upper tubular insert extending from the upper end of the cylinder providing releasable connection with the box-ended wrench;

a light assembly installed in the cylinder;

a cover rotationally mounted on the upper end of the cylinder between an OFF position turning off the light assembly and an ON position turning on the light assembly; and a lower tubular insert extending from the lower end of the cylinder for releasable connection with the socket, wherein light can emit from the light assembly through the lower tubular insert.

2. The luminescent extension according to claim 1 including an elastic frictional ring mounted on the upper tubular insert.

3. The luminescent extension according to claim 1 wherein the upper insert includes a knob formed thereon for facilitating the rotation thereof.

4. The luminescent extension according to claim 1 wherein the cylinder includes a thread formed thereon, and the cover includes a thread formed thereon for engagement with the thread of the cylinder.

5. The luminescent extension according to claim 4 wherein the upper insert includes a knob formed on an upper end.

6. The luminescent extension according to claim 5 including a spring compressed between the upper end of the cylinder and the knob.

7. The luminescent extension according to claim 1 wherein the light assembly a light bulb and at least one battery in contact with the light bulb.

8. The luminescent extension according to claim 7 wherein the light assembly includes a spring for biasing the at least one battery into firm contact with the light bulb.

9. The luminescent extension according to claim 7 wherein the light assembly includes several batteries.

10. The luminescent extension according to claim 9 wherein the light assembly includes a socket for receiving the batteries.

11. The luminescent extension according to claim 7 wherein the upper insert includes a rod extending from a lower end for contact with the at least one battery in the ON position.

12. The luminescent extension according to claim 1 including an elastic frictional ring mounted on the lower insert.

13. The luminescent extension according to claim 1 wherein the cylinder defines a recess, and the lower tubular insert includes an upper portion inserted in the recess in a non-rotational manner.

14. The luminescent extension according to claim 13 further including a fastener, wherein the cylinder defines a transverse hole communicated with the recess, and the upper portion of the lower tubular insert defines a transverse hole, and the fastener is inserted through the transverse hole of the cylinder into the transverse hole of the upper portion of the lower tubular insert.

15. The luminescent extension according to claim 14 wherein the fastener includes a thread formed thereon, and the transverse hole of the upper portion of the lower tubular insert includes a wall formed with a thread for engagement with the thread of the fastener.

16. The luminescent extension according to claim 1 wherein the cylinder defines a non-circular recess, and the lower tubular insert includes a non-circular portion inserted in the non-circular recess.

17. The luminescent extension according to claim 16 further including a fastener, wherein the cylinder defines a transverse hole communicated with the non-circular recess, and the upper portion of the lower tubular insert defines a transverse hole, and the fastener is inserted through the transverse hole of the cylinder into the transverse hole of the upper portion of the lower tubular insert.

18. The luminescent extension according to claim 17 wherein the fastener includes a thread formed thereon, and the transverse hole of the upper portion of the lower tubular insert includes a wall formed with a thread for engagement with the thread of the fastener.

* * * * *